US006764303B2

(12) United States Patent
Dane et al.

(10) Patent No.: US 6,764,303 B2
(45) Date of Patent: Jul. 20, 2004

(54) GAS BURNER FOR A COOKER

(75) Inventors: Bernard Dane, Montbazon (FR); Siu Hun Pierre Yam, Chattanooga, TN (US)

(73) Assignee: Sourdillon, Veigne (FR)

( * ) Notice: Subject to any disclaimer, the term of this patent is extended or adjusted under 35 U.S.C. 154(b) by 0 days.

(21) Appl. No.: 10/372,161

(22) Filed: Feb. 25, 2003

(65) Prior Publication Data

US 2003/0186182 A1 Oct. 2, 2003

(30) Foreign Application Priority Data

Mar. 29, 2002 (FR) ..... 02 04007

(51) Int. Cl.[7] ..... F23D 14/62

(52) U.S. Cl. ..... 431/354; 431/266; 239/553.3; 126/39 E

(58) Field of Search ..... 431/354, 266; 239/552, 553.3, 567; 126/39 E, 392 R

(56) References Cited

U.S. PATENT DOCUMENTS 2,220,247 A 11/1940 Kochendorfer et al.
3,921,913 A 11/1975 Capy
5,149,262 A 9/1992 Riehl
5,401,164 A * 3/1995 Yen ..... 431/354
5,704,778 A * 1/1998 Hsieh ..... 431/354
6,132,205 A * 10/2000 Harneit ..... 431/354
6,135,764 A 10/2000 Kwiatek
6,332,460 B1 * 12/2001 Paesani ..... 126/39 R

FOREIGN PATENT DOCUMENTS

EP 1 114 966 A1 7/2001
FR 2 414 684 8/1979

* cited by examiner

*Primary Examiner*—Alfred Basichas
(74) *Attorney, Agent, or Firm*—Stites & Harbison PLLC; Douglas E. Jackson

(57) ABSTRACT

Gas burner for a cooker, with a burner head provided with a frustoconical peripheral side wall and with a multiplicity of slots forming flame orifices, the burner head being topped by a cap, the side wall (2') being inclined (α) to the vertical by 10° to 20° and the bottom (8') of each slot (3) being inclined (β) to the horizontal by 20° to 30°; the ratio of the diameter (A) of the cap to the diameter (B) of the side wall (2) at mid-height of the outlet orifices (11) of the slots (3) is from 1.4 to 1.6; the stand-off (H) of the cap above the top of the burner head is from 1 to 15 mm; and the angle of inclination (γ) of the lower face (9) of the cap to the horizontal is from 3° to 15°.

6 Claims, 2 Drawing Sheets

GAS BURNER FOR A COOKER

FIELD OF THE INVENTION

The present invention relates to improvements to gas burners for cookers, comprising a burner head having an approximately frustoconical peripheral side wall with the small cross section thereof located at the top and including a multiplicity of slots distributed peripherally and forming flame orifices, the said burner head being topped by a cover or cap.

DESCRIPTION OF THE PRIOR ART

In FIG. 1 of the appended drawings, a conventional gas burner arrangement for a cooker has been shown highly schematically. This gas burner essentially comprises, and only as regards the invention, a burner head 1 having a peripheral side wall 2. This peripheral wall 2 is slightly frustoconical with its small cross section located at the top. The peripheral wall 2 is provided with a multiplicity of slots 3, with an approximately horizontal bottom 8, these being distributed peripherally and forming orifices for flames 4. The burner head 1 is topped by a removable cover or cap 5, which closes off the top of the slots 3 and defines the flame orifices.

As regards the rest of the gas burner, this may be constructed in any appropriate manner; in particular, for extra-flat burners, the burner may, in a manner known per se, include a radial annular venturi defined by the lower face of the cap 5.

In currently known gas burners, the side wall 2 of the burner head is inclined only very slightly to the vertical, this angle of inclination typically not exceeding 1 to 3°. As a result, the flames 4, which leave their respective orifices 3 approximately perpendicular to this wall 2, have a tendency to move substantially away from the wall of the burner head and come into contact with the bottom 6 of a vessel 7 of suitable dimensions for the burner only in the vicinity of the peripheral edge of the said bottom of the vessel, as may be clearly seen in FIG. 1. Under these conditions, the bottom of the vessel is heated less in its central region: the vessel is not heated substantially homogeneously over its entire surface, while an appreciable fraction of the heat escapes to the side and is lost.

U.S. patent application Ser. No. 10/245,939 filed on Sep. 18, 2002 and assigned to the same Assignee, and not yet published, aimed to provide an improved arrangement which, for a given diameter of the burner, leads to an appreciably increased efficiency of the burner and to a substantially increased heating rate, without furthermore this resulting in any complication of the structure or of the manufacture of the burner.

The improved arrangement provided is shown in FIG. 2, in which the representation of the gas burner 1' is identical to that given in FIG. 1 apart from the improved arrangements, and the same numerical references have been retained in order to denote the components or parts that are unchanged.

The peripheral side wall 2' has a more pronounced conicity than in the prior burners and its angle of inclination $\alpha$ to the vertical is around 10° to 20°, typically about 15°.

In addition, the bottom 8' of each slot forming a flame orifice, which extends transversely to the said wall 2, has an angle of inclination $\beta$ to the horizontal which is around 20° to 30°, typically about 25°.

Under these conditions, as may be seen in FIG. 2 (in which the cap 5 remains identical, both in shape and in position, to that which it had in FIG. 1), the flames 4 leave the respective orifices 3 closer to the vertical than in the configuration of FIG. 1 so that they reach the bottom 6 of the vessel in a more central region thereof. This bottom is heated more uniformly and, correspondingly, a smaller fraction of the heat escapes to the side. In total, the heat is transmitted to the vessel and to its contents under appreciably better conditions, and the overall efficiency of the burner is substantially improved.

The implementation of the arrangements of the invention results in a shorter heating time, for example to bring a given volume of liquid to boiling. To be more specific, to bring a 6 litre volume of water, contained in a vessel having a diameter of 203 mm, from a temperature of 22° C. to a temperature of 98° C., a time of around 21 min is required with a burner designed in accordance with the invention, as opposed to about 25 min with a conventionally designed burner. The arrangements according to the invention therefore allow the heating time to be substantially reduced (by around 16% in the example in question) and therefore result in a corresponding saving in gas consumption.

The arrangement of the burner related to in U.S. patent application Ser. No. 10/245,939 is therefore entirely satisfactory within the context of the use for which it was specifically designed.

However, some users, who need rapid burners for certain preparations, also need slow cooking (simmering) for other preparations. In the latter case, the use of a rapid burner turns out to be unsuitable, even if it is set to the minimum power. Thus, these users, not wishing for the cooker to be equipped with a multiplicity of burners having different characteristics, which have proved to be expensive, have expressed the desire to be able to cook slowly and uniformly over a long period of time with the rapid burner, which must, of course, retain its rapid heating characteristics that are so appreciated.

SUMMARY OF THE INVENTION

The invention therefore provides an improved arrangement of the aforementioned rapid burner, suitable for making it capable of gentle and uniform cooking when it is set to minimum power, whereas it retains its rapid heating characteristics and qualities when it is set to high power.

For these purposes, the invention provides a burner for a cooker, comprising a burner head bounded by a substantially frustoconical peripheral side wall having a small cross section at the top and including a multiplicity of slots distributed peripherally and forming flame orifices, the said burner head being topped by a cover or cap, in which burner head the side wall has an angle of inclination to the vertical of about 10° to 20° and in which burner head the bottom of each slot forming a flame orifice, which extends transversely to the said side wall, has an angle of inclination to the horizontal of about 20° to 30°, which burner, being designed according to the invention, is characterized in that the ratio of the diameter of the cap to the diameter of the side wall at approximately mid-height of the outlet orifices of the slots is between about 1.4 and 1.6, in that the stand-off of the lower face of the cap with respect to the bearing surface of the cap on the top of the burner head is between about 1 and 15 mm, preferably about 10 mm, and in that the angle of inclination to the horizontal of the lower face of the cap is between about 3° and 15°, preferably about 10°.

Thus, the invention aims to give the cap a specific geometry which, in combination with the main arrangements of U.S. patent application Ser. No. 10/245,939, confers two operating modes on the burner:

when the burner is used at minimum power, the flames, which are small, remain contained beneath the cap without being able to extend beyond the outline of the latter; these flames, which are in contact with the peripheral annular region of the lower face of the cap, heat the cap, which then diffuses the heat via its entire upper face towards the bottom of the vessel located above it: this results in well-distributed and gentle heating, propitious for simmering;

when the burner is used at normal or high power, the flames, well formed, go around the cap and the burner operates under the conditions explained in document U.S. Ser. No. 10/245,939 providing rapid heating.

Now, the arrangements according to the invention, which are particularly beneficial because of the two functions in use that they provide, are also particularly beneficial as they are extremely simple to implement; these arrangements rely on a specific geometry of the burner body and of the cap, and they require no additional piece or component.

According to a simple embodiment of the burner of the invention, the aforementioned stand-off of the underface of the cap results from the fact that the lower face of the cap has a platform projecting vertically downwards from the said annular portion which surrounds it, the said platform constituting the bearing surface for the cap to bear on the top of the burner head.

BRIEF DESCRIPTION OF THE DRAWINGS

The invention will be more clearly understood on reading the detailed description in which reference will be made to the appended drawings in which.

DETAILED DESCRIPTION OF THE INVENTION

Figure 1:
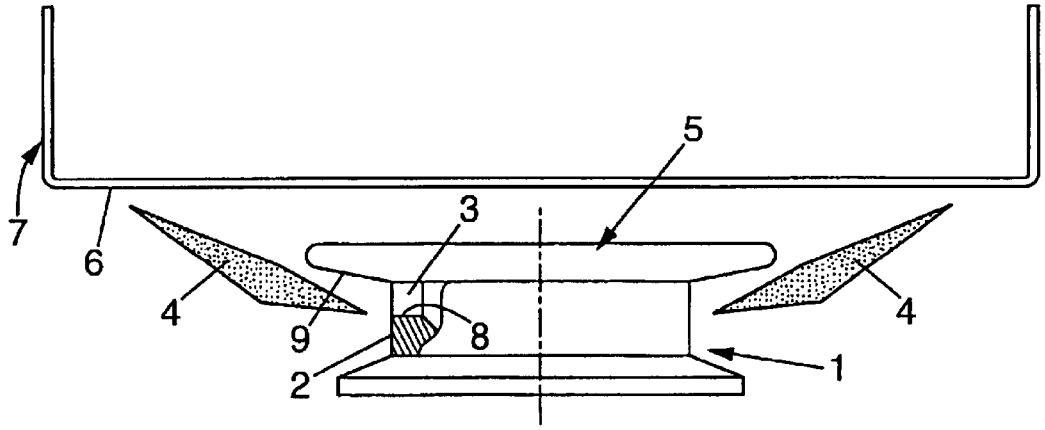
FIG. 1 PRIOR ART
FIG. 1 is a schematic side view, in partial section, of a gas burner designed according to prior art.
Figure 2:
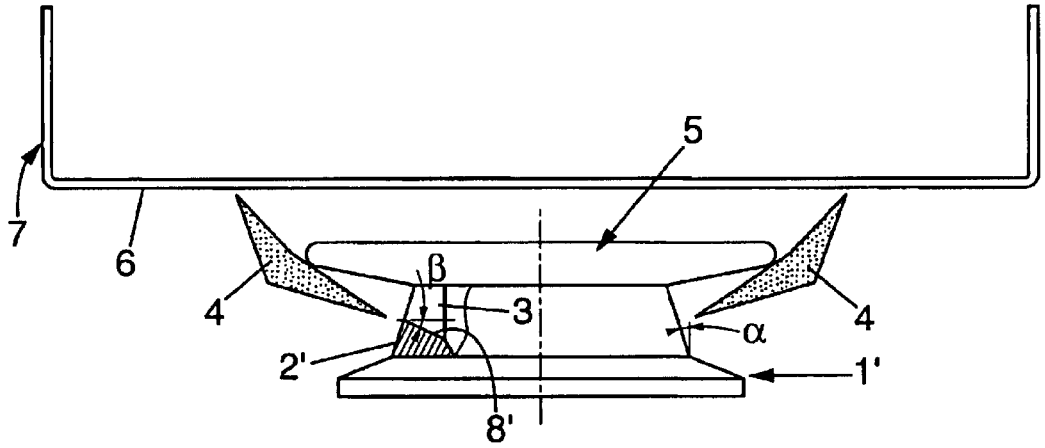
FIG. 2 PRIOR ART
FIG. 2 is a schematic side view, in partial section, of an improved gas burner designed according to prior art.
Figure 3:
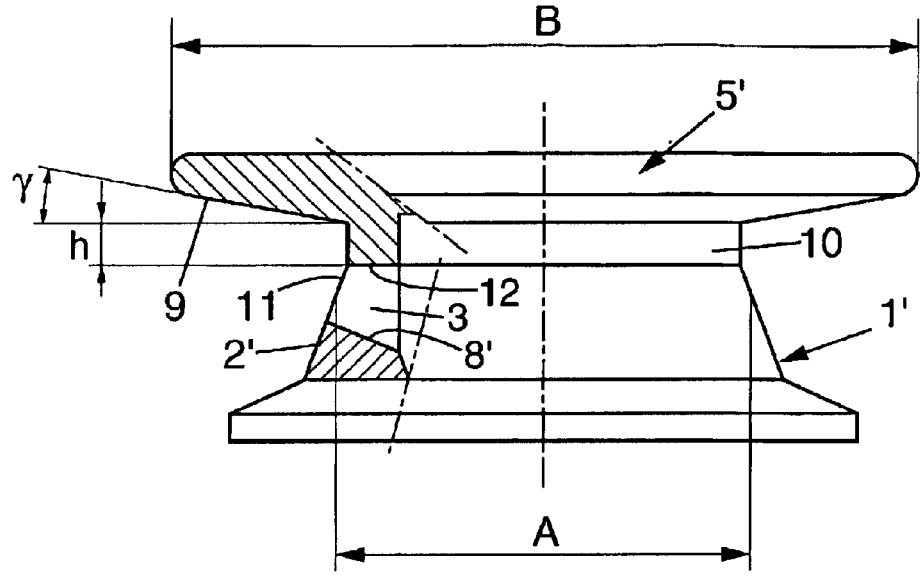
FIG. 3 is a schematic side view, in partial section, of a gas burner designed according to the invention.

In FIG. 3, to which reference will first of all be made, the various elements and parts of the burner are denoted by the same numerical references as in FIG. 2.

The design of the burner 1' according to the invention is characterized by the following arrangements:

1) the ratio of the diameter B of the cap 5' to the diameter A of the side wall 2' measured at approximately mid-height of the outlet orifices 11 of the slots 3 is between 1.4 and 1.6. This therefore ensures that, in reduced-power operation, the flames cannot go around the cap and remain beneath the peripheral annular portion 9, which they heat;

2) the peripheral annular portion 9 of the lower face of the cap 5' is stood off by a height h with respect to the top 12 of the flame orifices, this stand-off being between about 1 mm and 15 mm, typically being around 10 mm. In practice, this result may be obtained, as illustrated in FIG. 3, by producing the central part of the lower face of the cap 5' (which is surrounded by the abovementioned peripheral annular portion 9) in the form of a platform 10 projecting vertically downwards. It is via this platform 10 that the cap 5' rests on the top of the burner head 1' designed, as such, in an identical manner to FIG. 2. This stand-off clears a greater space around the flame orifices, which makes it easier for the flames 4 to be more effective by them standing up in normal operation;

3) the peripheral annular portion 9 of the lower face of the cap 5' is raised radially outwards, making an angle $\gamma$ of between about 3° and 15°, typically about 10°, with the horizontal. Such an angle of inclination also contributes to clearing the space around the flame orifices, thereby making it easier for the flames to be effective by them standing up in normal operation.

Figure 4:
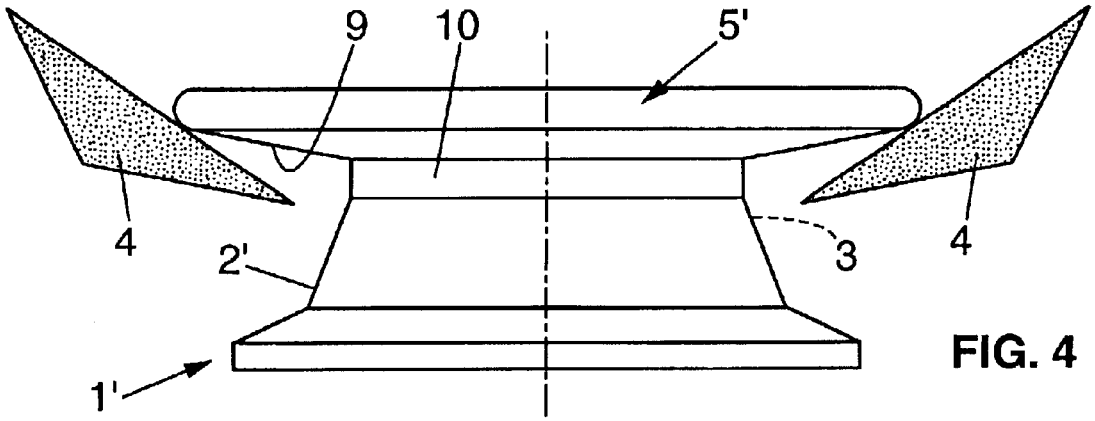
FIGS. 4 and 5 are side views of the burner of FIG. 3 illustrated in two different operating modes, respectively.

FIG. 4 illustrates the operation at normal power or at full power of the burner of FIG. 3. Since the burner 1' employs the arrangements presented in above cited document U.S. Ser. No. 10/245,939 the flames 4 are generated under the conditions indicated above with regard to FIG. 2. The flames 4 extend beyond the cap 5', but stand up more than in a conventional burner configuration so that they reach the bottom of a vessel in a more central region of the latter and therefore provide more rapid heating.

Figure 5:
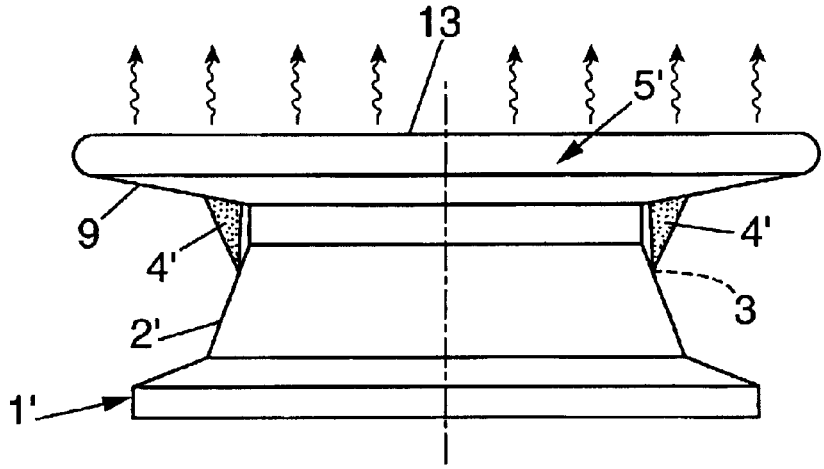

In contrast, FIG. 5 illustrates the operation of the same burner at minimum power. The short flames 4' remain concentrated below the cap 5', in contact with the peripheral annular portion 9 of the lower face of the latter. The cap 5', being made of a good thermal conductor (for example steel, cast aluminium, etc.), in bulk form, is heated and diffuses the heat relatively uniformly via its upper face 13. Such an operating mode provides gentle, regular and uniform heating, which in particular allows simmering for a long period of time.

What is claimed is:

1. A gas burner for a cooker, comprising a burner head bounded by a substantially frustoconical peripheral side wall having a small cross section at the top and including a multiplicity of slots distributed peripherally and forming flame orifices, said burner head being topped by a cover or cap, in which burner head the side wall has an angle of inclination ($\alpha$) to a vertical of about 10° to 20° and in which burner head the bottom of each slot forming a flame orifice, which extends transversely to the said side wall, has an angle of inclination ($\beta$) to a horizontal of about 20° to 30°, wherein the ratio of the diameter of the cap to the diameter of the side wall at approximately mid-height of the outlet orifices of the slots is between about 1.4 and 1.6, wherein the stand-off of the inclined lower face of the cap with respect to the bearing surface of the cap on the top of the burner head is between about 1 and 15 mm, and wherein the angle of inclination ($\gamma$) to a horizontal of the lower face of the cap is between about 3° and 15°.

2. A gas burner according to claim 1, wherein said stand-off of the cap is about 10 mm.

3. A gas burner according to claim 1, wherein said angle of inclination ($\gamma$) of the lower face of the cap to the horizontal is about 10°.

4. A gas burner according to claim 1, wherein said angle of inclination ($\alpha$) of the side wall to the vertical is about 15°.

5. A gas burner according to claim 1, wherein said angle of inclination ($\beta$) of the bottom of each slot to the horizontal is about 25°.

6. A gas burner according to claim 1, wherein said lower face of the cap has a platform projecting vertically downwards from the said annular portion which surrounds it, said platform constituting the bearing surface for the cap to bear on the top of the burner head.

* * * * *